United States Patent [19]

Bartell et al.

[11] Patent Number: 4,889,236

[45] Date of Patent: Dec. 26, 1989

[54] CREDIT CARD-STYLE MEDICATION PACKAGE

[75] Inventors: Ralph Bartell, Lincoln Park; Roger Boissonneault, Long Valley; Monica Blischok, Linden, all of N.J.

[73] Assignee: Warner-Lambert Company, Morris Plains, N.J.

[21] Appl. No.: 160,977

[22] Filed: Feb. 26, 1988

[51] Int. Cl.[4] ..... B65D 83/04; B65D 85/56

[52] U.S. Cl. ..... 206/531; 206/534; 206/528

[58] Field of Search ..... 206/531, 534, 532, 528

[56] References Cited

U.S. PATENT DOCUMENTS

| | | | |
|---|---|---|---|
| 2,317,860 | 4/1943 | Sorensen | 206/531 |
| 3,381,808 | 5/1968 | McGraw, II | 206/534 |
| 3,397,671 | 8/1968 | Hartman, Jr. et al. | 206/534 |
| 3,494,322 | 2/1970 | Dubbels | 206/534 |
| 3,504,788 | 4/1970 | Gray | 206/531 |
| 3,958,690 | 5/1976 | Gee | 206/534 |
| 4,295,567 | 10/1981 | Knudsen | 206/534 |
| 4,340,141 | 7/1982 | Fischer | 206/534 |
| 4,574,954 | 3/1986 | Reid | 206/531 |

FOREIGN PATENT DOCUMENTS

| | | | |
|---|---|---|---|
| 2017051 | 9/1979 | United Kingdom | 206/534 |

*Primary Examiner*—William Price

*Attorney, Agent, or Firm*—Francis J. Tinney

[57] ABSTRACT

A rigid, tripartite, credit card-style blister-pack medication package is disclosed which is particularly useful for dispensing medications which must be taken on a calendar day schedule. The package is of discrete design and may be conveniently carried in a purse or billfold.

1 Claim, 3 Drawing Sheets

CREDIT CARD-STYLE MEDICATION PACKAGE

BACKGROUND OF THE INVENTION

The present invention is related to blister-pack type medication packages. More particularly, this invention concerns a tripartite, credit card-sized blister-pack medication package.

Many medications must be taken over a number of days for their effective administration. This has created the need for medication packages which provide a means for the patient to easily follow the dosage regimen from day to day to ensure patient compliance.

Typical of such drugs are the so-called birth control pills which are taken over a period of days corresponding to a woman's menstrual cycle or antiinflammatory drugs for the treatment of arthritis and similar ailments. Various packages have been proposed to meet this need, ranging in design from purse compact-type packages to so-called "blister-pack"-type packages.

U.S. Pat. No. 4,429,792 discloses a medication-dispensing card having a plurality of sealed compartments for holding single doses of medication. The card is so adapted as to permit the recovery of unused medication in the sealed compartments without breaking the seal of individual compartments to permit reuse in an institutional setting.

U.S. Pat. No. 4,534,468 discloses a two-part blister-pack medication package having a clear sheet with a plurality of pill-containing pockets and a frangible backing sheet. The backing sheet is further marked with calendar indicia.

British Patent Specification No. 1,271,939 discloses medication package comprising a folding, coated paperboard structure which encloses and sandwiches a blister-pack of clear plastic and foil backing.

Numerous box-type pill dispensing packages having daily unit doses of drugs are pictured in the "Product Identification" section of the Physician's Desk Reference, Medical Economics Company, Inc., Oradell, N.J. 07649. (See for example the 41st Edition (1987) at pages 404, 405, 412, 416, 417, 419, 420, 421, 429, 432, 433, 436, and 437.)

When the medication comprises birth control pills, the patient audience comprises women who find box-type pill dispensing packages often of a size which is inconvenient to carry in a purse.

On the other hand, many of the individual flat blister-pack packages are of a construction which does not stand up well over the period of time during which the medication must be used. If the package materials and/or design are not sufficiently rigid, the package often becomes frayed or crumpled during its use. This is especially true as successive pill or tablet chambers are emptied and the mechanical strength of the package as a whole deteriorates.

Often, both types of packaging are of sufficiently complicated construction as to add to the costs and complexities of manufacture. There is thus a need for a small and sturdy blister-pack medication package which is convenient to carry and is of simple manufacture.

SUMMARY OF THE INVENTION

The present invention provides credit card-style medication package comprising a tripartite structure having an upper portion comprising a rigid sheet of material having the peripheral dimensions of a credit card, top and bottom surfaces, and having a plurality of spaced apart apertures; a middle portion comprising a sheet of flexible material having substantially the same peripheral dimensions of said upper portion, top and bottom surfaces and a plurality of pockets formed therein for containing unit doses of medication, at least a portion of said pockets containing medication in unit dosage form, said plurality of pockets so spaced and sized as to pass upward through said plurality of spaced apart apertures in said upper portion, the top surface of said middle portion being firmly attached to the bottom surface of said upper portion; and a lower portion comprising a sheet of frangible material having substantially the same peripheral dimensions as said middle portion, and top and bottom surfaces, the top surface of said lower portion sealed to the bottom surface of said middle portion to protect said medication.

DETAILED DESCRIPTION

Figure 1:
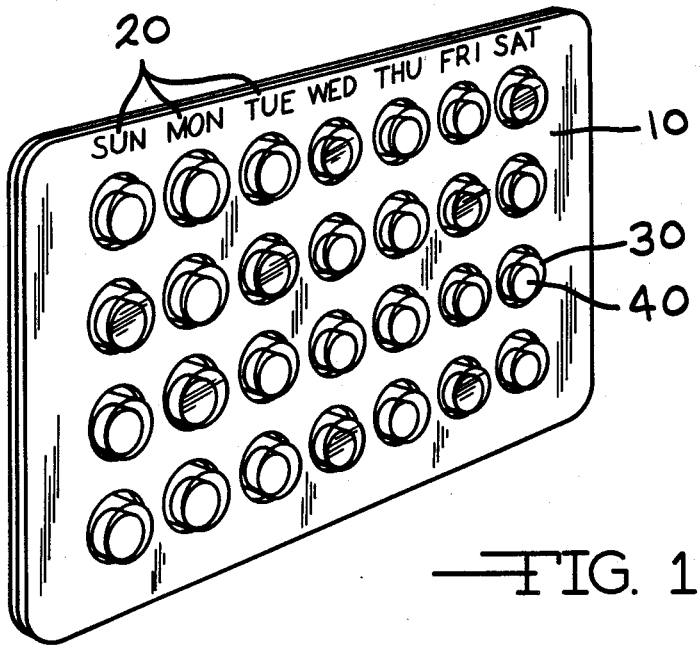
FIG. 1 is a perspective drawing of the credit card-style medication package of this invention.

Referring to FIG. 1, the present invention provides a compact, rigid blister-pack medication dispensing card, 10, having calendar indicia, 20. The card, 10, has a plurality of chambers or pockets, 30, for containing pills or tablets, 40.

The peripheral dimensions of the card, 10, are the same as common credit cards, or approximately 3⅜ inches (86 mm) by 2⅛ inches (53.98 mm).

Figure 3:
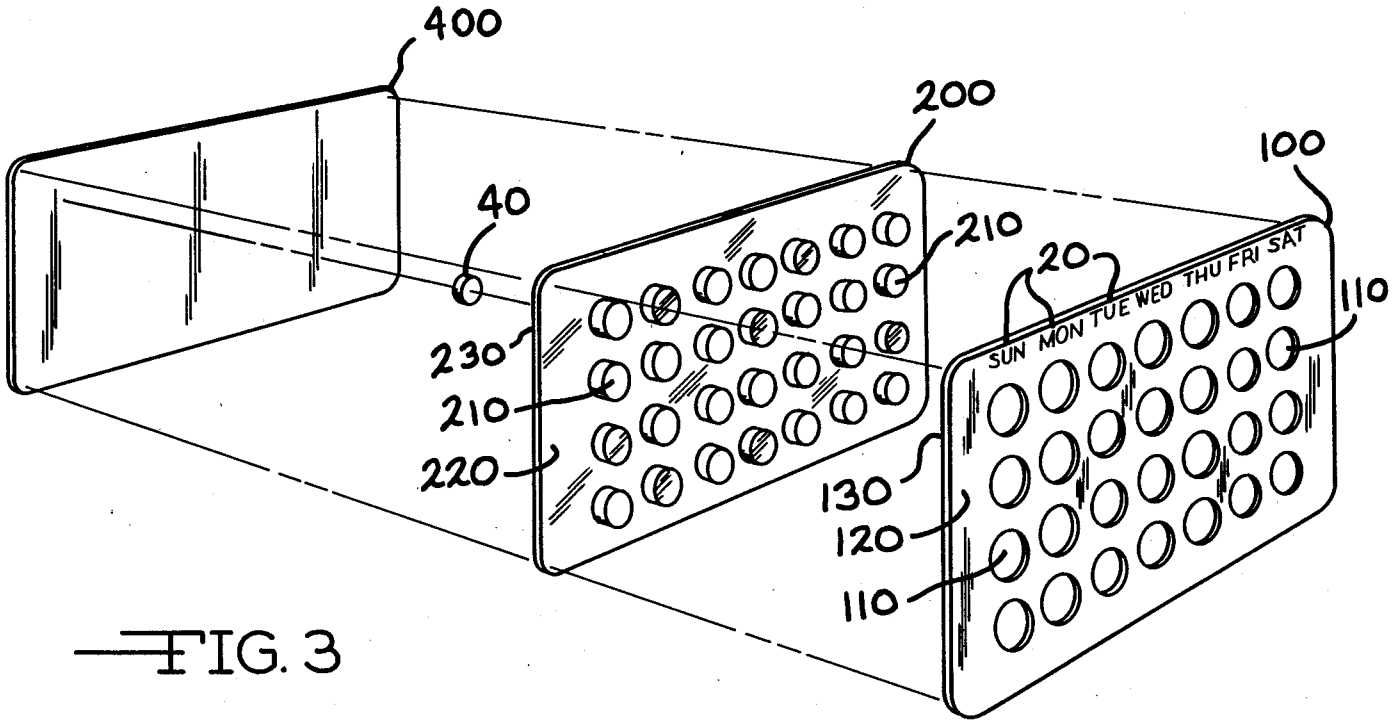
FIG. 3 is an exploded view showing the three portions of the medication package of the present invention.

As shown in FIG. 3, the card is constructed of three portions. An upper portion, 100, is made of rigid material, preferably a plastic such as polyvinyl chloride of a thickness ranging between about 0.020 inches (0.51 mm) and about 0.040 inches (1.02 mm), preferably about 0.0265 inches (0.673 mm). The polyvinyl chloride may be colored, if desired, to aid in the identification of the product.

The top surface, 120, of upper portion 100 is imprinted with the desired calendar indicia, 20, and any other desired product identification information and is subsequently coated with a protective clear laminating layer. This protective surface coating is of a thin layer of clear polyvinyl chloride of a thickness of between about 0.0015 inches (0.038 mm) and 0.002 inches (0.05 mm), preferably about 0.00185 inches (0.047 mm). This coating protects the imprinting on the card and prevents its intentional or accidental erasure.

The bottom surface, 130, of upper portion 100 is similarly laminated with a layer of clear polyvinyl chloride of a thickness between about 0.0015 inches (0.038 mm) and 0.002 inches (0.05 mm). The laminated bottom surface, 130, is further coated with a heat-actuated, solvent-based sealing material of any of a number of types known to practitioners of the packaging art for sealing polyvinyl chloride.

The upper portion, 100, is punched with a plurality of apertures, 110, of a size and shape to ultimately contain the desired medication in the finished package. The apertures, 110, thus may be circular as shown in FIG. 3, or may be of elliptical or other shape as necessary to house the desired pill or tablet shape.

The middle portion, 200, of the medication package of this invention is formed of a thin, flexible material such as clear polyvinyl chloride of a thickness between about 0.005 inches (0.127 mm) and 0.015 inches (0.381 mm), preferably about 0.0075 inches (0.19 mm), and of peripheral dimensions substantially equal to those of upper portion, 100.

The portion, 200, has a plurality of pockets, 210, which are spaced apart in such a way so as to match the spacing of the apertures, 110, in the upper portion, 100, and of a diameter less than the apertures, 110, the pockets thus being adapted to extend through the apertures 110. The pockets, 210, are formed by thermal, vacuum-drawing of the middle portion, 200, in accordance with standard practices in the packaging art.

The bottom surface, 230, of middle portion 200 is coated with a thin layer of heat-activated, solvent-based sealant of the type previously described.

The lower portion, 400, is formed of a thin layer of frangible material, preferably metal foil such as aluminum foil, of a thickness of between about 0.001 inches (0.025 mm) and 0.005 inches (0.13 mm), preferably about 0.002 inches (0.05 mm).

Figure 2:
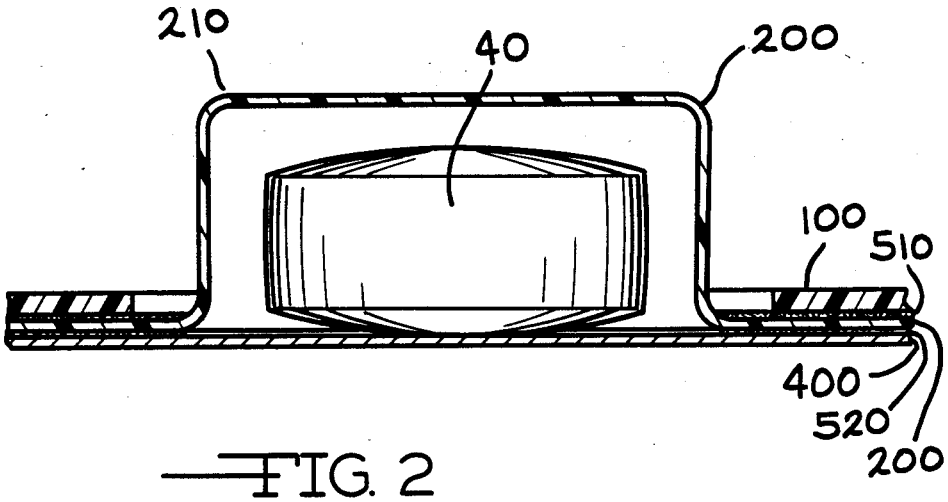
FIG. 2 is a cutaway section of a portion of the medication package of this invention showing a detail of one pocket.

Referring to FIG. 2, the construction of a single pill or tablet pocket, 210, of the medication package of this invention is shown in cross-section. The top surface of the metal foil backing, or lower portion of the package, 400, is shown sealed against the bottom surface of the middle portion, 200, by means of the heat-actuated sealant layer, 520. The top surface of the middle portion, 200, is likewise sealed against the bottom surface of the upper portion, 100, of the medication package by means of heat-actuated sealant layer, 510.

The pockets, 210, in middle portion 200 are vacuum formed to be of a diameter smaller than that of the aperture in top portion 100 and thus extend up through the aperture with sufficient depth to house the pill or tablet 40.

The medication package of this invention may be manufactured by preparing upper portion 100, middle portion 200, and lower portion 400 in larger sheets containing any convenient number of individual units and subsequently assembled prior to being cut into individual units.

Alternatively, the larger sheet of each portion may be cut into individual units prior to assembly with the other portions.

The card may optionally be accompanied by a pouch container or holder intó which the card may be placed for discreetness. The pouch or holder is of a size to conveniently hold the credit card blister-pack, and preferably has a flap cover to fold over and enclose the card completely. The holder may be made of a suitable soft pliable material such as vinyl or, preferably, suede.

Figure 4:
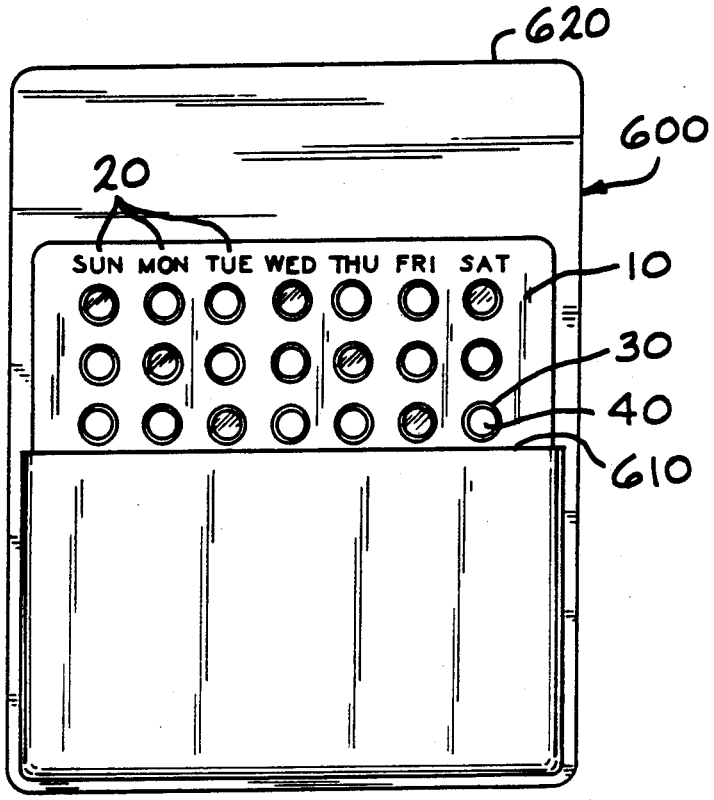
FIG. 4 is a front view showing the open pouch container with the credit card-style medication package partially inserted into the pouch container.

Referring to FIG. 4, the pouch container, 600, is shown in an open position with the flap cover, 620, and the credit card-style medication package, 10, partially inserted into the pouch, 610, of the pouch container, 600.

The tripartite blister-pack medication packages of this invention thus present a number of advantages over similar prior art packages. The packages of this invention are of simple design and are thus conveniently and inexpensively manufactured.

They are attractive and of a convenient size for carrying in the patient's pocket, purse or billfold, and of a design which enhances discreteness.

Market research was conducted with 500 females in a geographically dispersed sample. The group was asked to compare the credit card-style blister-pack medication package of the present invention with existing oral contraceptive packages. The package of the present invention was preferred overall by the sample.

Oral contraceptive use is highest in the United States among females of 14 to 25 years of age. The market research indicated that, among females using oral contraceptives, the two most important features of the compliance-directed medication package of this invention are its small size and discreteness.

The optional black suede carrying case, which gives the package the appearance of a calculator or credit card holder, was perceived by the women polled in the marketing survey as enhancing the discreetness of design.

Moreover, the rigid construction of the credit card blister-pack is able to withstand considerable physical abuse and maintain its shape throughout the period of use as the pill or tablet chambers are emptied.

We claim:

1. A credit card-style medication package comprising a tripartite structure having (a) an upper portion comprising a rigid sheet of polyvinyl chloride having
- a thickness of between about 0.020 inches (0.51 mm) and about 0.040 inches (1.02 mm),
- peripheral dimensions of approximately 3⅜ inches (86 mm) by 2⅛ inches (53.98 mm),
- top and bottom surfaces,
- a plurality of spaced apart apertures, and calender indicia protected by a clear laminated surface layer;

(b) a middle portion comprising a sheet of clear polyvinyl chloride having
- a thickness between about 0.005 inches (0.127 mm) and 0.015 inches (0.381 mm),
- substantially the same peripheral dimensions of said upper portion,
- top and bottom surfaces, and
- a plurality of pockets formed therein for containing unit doses of medication, at least a portion of said pockets containing medication in unit dosage form, said plurality of pockets so spaced and sized as to pass upward through said plurality of spaced apart apertures in said upper portion, the top surface of said middle portion being firmly sealed to the bottom surface of said upper portion; and (c) a lower portion comprising a sheet of metal foil having
- a thickness of between about 0.001 inches (0.025 mm) and 0.005 inches (0.13 mm),
- substantially the same peripheral dimensions as said middle portion, top and bottom surfaces, the top surface of said lower portion sealed to the bottom surface of said middle portion to protect said medication and optionally said credit card-style medication package further including a soft, pliable pouch having a foldable cover flap for enclosing and containing said package.

* * * * *